US006139290A

United States Patent [19]

Masterson

[11] Patent Number: 6,139,290

[45] Date of Patent: Oct. 31, 2000

[54] METHOD TO SEAL A PLANETARY ROTOR ENGINE

[76] Inventor: Frederick Masterson, 204 Kenyon Rd., Richmond, Vt. 05477

[21] Appl. No.: 09/086,546

[22] Filed: May 29, 1998

[51] Int. Cl.[7] ..... F01C 1/12; F01C 19/00; F02B 53/00

[52] U.S. Cl. ..... 418/1; 418/83; 418/104; 418/109; 418/141; 418/196; 277/558; 277/566

[58] Field of Search ..... 418/1, 83, 104, 418/109, 141, 196; 277/554, 558, 566

[56] References Cited

U.S. PATENT DOCUMENTS

| | | | |
|---|---|---|---|
| 165,528 | 7/1875 | Barber | 418/165 |
| 517,273 | 3/1894 | Godfrey | 418/109 |
| 710,756 | 10/1902 | Colbourne | 418/196 |
| 1,349,882 | 8/1920 | Homan | 418/196 |
| 2,097,881 | 11/1937 | Hopkins | 418/196 |
| 2,410,341 | 10/1946 | Delamere | 418/197 |
| 2,841,429 | 7/1958 | McCuistion | 277/402 |
| 3,234,888 | 2/1966 | Wise et al. | 418/196 |
| 3,439,654 | 4/1969 | Campbell, Jr. | 418/196 |
| 3,799,126 | 3/1974 | Park | 418/196 |
| 3,809,026 | 5/1974 | Snyder | 418/196 |
| 3,883,277 | 5/1975 | Keller | 418/137 |
| 3,921,593 | 11/1975 | Lamm | 418/83 |
| 3,950,116 | 4/1976 | Sharples | 418/83 |
| 3,990,410 | 11/1976 | Fishman | 418/196 |
| 4,037,998 | 7/1977 | Goloff | 418/83 |
| 4,157,882 | 6/1979 | Theisen | 418/64 |
| 4,274,815 | 6/1981 | Lechler et al. | 418/91 |
| 4,472,122 | 9/1984 | Yoshida et al. | 418/104 |
| 4,502,856 | 3/1985 | Frank | 418/137 |
| 4,626,181 | 12/1986 | Dantlgraber | 418/83 |
| 4,664,607 | 5/1987 | Jones | 418/83 |
| 4,755,115 | 7/1988 | Ankaike | 418/104 |
| 4,759,325 | 7/1988 | Jones | 418/83 |
| 4,934,325 | 6/1990 | Snyder | 418/196 |
| 4,968,234 | 11/1990 | Densch | 418/196 |
| 5,055,016 | 10/1991 | Kawade | 418/179 |
| 5,092,752 | 3/1992 | Hansen | 418/137 |
| 5,271,364 | 12/1993 | Snyder | 418/196 |
| 5,284,427 | 2/1994 | Wacker | 418/83 |
| 5,341,782 | 8/1994 | McCall et al. | 418/196 |
| 5,385,351 | 1/1995 | White | 418/104 |
| 5,429,374 | 7/1995 | Eichenberger | 277/558 |
| 5,545,431 | 8/1996 | Singh | 427/205 |

FOREIGN PATENT DOCUMENTS

| | | | |
|---|---|---|---|
| 721481 | 2/1943 | Germany | 418/141 |
| 2609623 | 9/1977 | Germany . | |
| 2819664 | 6/1979 | Germany . | |
| 3116283 | 11/1982 | Germany . | |
| 64-41690 | 2/1989 | Japan | 418/109 |
| 4-063997 | 2/1992 | Japan . | |
| 4-318298 | 11/1992 | Japan . | |
| 1691556 | 11/1991 | U.S.S.R. . | |

*Primary Examiner*—John J. Vrablik
*Attorney, Agent, or Firm*—Richard C. Litman

[57] ABSTRACT

Methods of sealing a planetary rotor engine, and the resulting seals, are described which improve the engine's efficiency and solves each of three main problem areas. A first method and resulting dynamic seal for sealing the rotor face surfaces as they translate across one another to constantly reform the contact between each other includes the key step of moving the shaft centerlines of each of the rotors, thereby radially positioning the rotors along diametric axes at positions which compensate for varying thermodynamic conditions (e.g. thermal expansion or contraction of rotor materials). A second method and resulting dynamic seal for effectively minimizing leakage between the end space formed between the rotor end and the case includes the key step of introducing a surface depression of any shape on one, or both, of the rotor end and opposing casing, thereby eliminating the need for a frictional seal and, in essence, forming a pressure wave plug. A third method and resulting dynamic seal for sealing around the rotor centershaft takes advantage of and is responsive to the changes in pressure and partial vacuum pulses during the operation cycles of the engine. An annular pivot and lever seal comprises a specially configured annulus for surrounding the centershaft having, generally described, a pivotal H-shaped cross section configuration adapted to seesaw in correspondence with positive and negative pressure changes over a single pressure wave to seal against the adjacent inner wall of the rotor case.

14 Claims, 6 Drawing Sheets

METHOD TO SEAL A PLANETARY ROTOR ENGINE

BACKGROUND OF THE INVENTION

1. Field of the Invention

The present invention relates generally to internal combustion engines, and more particularly to a method for sealing planetary rotor engines and the resulting dynamically formed seals. Planetary rotor engines include three or more rotors which are radially displaced from the center of the device and rotate together to alternately increase and decrease the volume of a chamber defined by the rotors, thereby defining three major junctures which require sealing.

2. Description of the Related Art

The best known general subtype of internal combustion engines is the reciprocating piston machine, which has been adapted for operation for innumerable applications. However, a lesser known configuration for internal combustion engines is the planetary rotor engine. Generally described, the planetary rotor engine comprises a plurality of radially displaced rotors which are keyed to a like number of shafts about a central chamber. The shape of the rotors is defined by four quadrantal arcs of a circle, with two opposite arcs having a relatively large radius and two arcs between the larger arcs, having relatively smaller radii. When the axes of the rotors are positioned on a circle with the major axes of the rotors oriented in the same direction and each of the rotors touching the two adjacent rotors, they define a volume captured between the rotors. When the rotors are rotated in the same direction and at the same rotational velocity, their shapes result in portions of their respective faces remaining in constant close proximity to one another at all times, and changing the volume defined by the rotors at a regular frequency occurring twice per rotor rotation. The rotors are rotated by harnessing explosive forces directed against the faces of the rotors forming the chamber, thereby translating them into useful mechanical energy.

However, in contrast to the better known and popular classes of internal combustion engines (i.e. gasoline piston, diesel piston, "Wankel" rotary-type, jet, etc.), such planetary rotor engines have a potential as a class to significantly advance the art of internal combustion engine technology for reasons inherent to its design. Such advantages include 1) a reduced weight and size ratio needed to produce a unit of power, 2) a reduction in number of parts, in turn permitting a wider RPM range, 3) a higher leverage ratio (i.e. greater torque from less pressure), each of which lead to further advantages useful to the consumer market, namely more work performed for less fuel consumption (i.e. greater fuel efficiency), with consequent reduction in pollution.

However, these advantages have not been realized primarily due to a failure in the prior art to teach an adequate means of sealing the combustion chamber. Therefore, the principles behind the planetary rotor engine have never been successfully developed for commercial use, primarily due to the heretofore unsolved problems of sealing the mechanism properly in order to provide the necessary operational efficiency.

To understand the seals of the present invention, the junctures needing sealing which are formed by components of a planetary rotor engine need be understood. More specifically, a seal of predetermined tolerance, from zero upwards, must be provided at three critical locations, namely, 1) the rotor faces, 2) the ends of the rotors and corresponding case ends, and 3) the rotor shafts. Until the present, static seals, which are typically interposed between the moving surface and usually a static component, have been tried and found unsuccessful. Therefore, a dynamic seal must be adapted to each of the three critical areas.

With respect first to the formation of the combustion volume between the plurality of moving rotor faces, a first dynamic seal must be defined to seal potential gaps as the rotor face surface translates across varying spatial coordinates to constantly reform the contact between a plurality of moving rotor surfaces and thereby define an enclosed combustion volume. Second, during any given operational cycle, the combustion volume is subjected to pulses caused by alternating combustion pressures and partial vacuums, the effect of which pulses must be considered at the juncture of the rotor ends and casing where an end space is formed. Through this end space, the pulses leak and adversely effect the centershaft seals supporting the rotor and casing (as well as engine performance, etc.). Thus, a second dynamic seal must be defined to effectively seal such space and minimize the adverse effect of alternating pulses leaking between the end space formed between the rotor end and the case. Third, the centershaft seal itself can be redesigned as a third dynamic seal to minimize the adverse pulse effects and increase its life by decreasing frictional thermal and wear conditions during low-pulse conditions (i.e. when high sealing forces are less necessary).

Moreover, the present invention considers and overcomes the problems of maintaining uniform and consistent dynamic seals as they undergo a plurality of physical effects during operation, including physical wear, thermal expansion and contraction of materials, and engine performance-related changes such as oscillating pressures and partial vacuums created during combustion cycles. Accordingly, the present invention responds to these problems and needs by providing both a method embodying the inventive principle necessary to effectively seal a planetary rotor engine, as well as, by providing various novel mechanisms embodying the principle. The method of the present invention establishes both rotor face and rotor end and shaft seals, i.e. the means, which provide the required sealing in order to allow the planetary rotor engine to be practicable.

The planetary rotor engines as a class are defined as exemplified by the following related art, but none has satisfactorily solved the problem of sealing the combustion chamber as it dynamically forms and reforms. One of the first was described in U.S. Pat. No. 710,756 issued on Oct. 7, 1902 to Thomas S. Colbourne, titled "Rotary Engine," wherein the rotors each have relatively sharp or pointed ends, which is no more than a special case of the smaller minor diameter arcs later used in such rotors. Colbourne is silent regarding any sealing means for his engine. Likewise, U.S. Pat. No. 1,349,882 issued on Aug. 17, 1920 to Walter A. Homan, titled "Rotary Engine," describes a planetary rotor mechanism of the pseudo-elliptical rotor configuration. Homan, however, recognizes the difficulty in sealing the working chamber of such machines, and attempts to solve the problem by providing a four way floating seal within the working chamber. Assuming the Homan roller device to be effective, it nevertheless decreases the efficiency of the planetary rotor machine to which it is applied, due to the volume it takes up within the working chamber of the machine, unlike the present rotor sealing means which requires no additional volume within the working chamber of the engine.

Not until U.S. Pat. No. 2,097,881 issued on Nov. 2, 1937 to Milton S. Hopkins, titled "Rotary Engine," is an essentially complete planetary rotor engine described, primarily directed to providing a valve mechanism for such an engine. Hopkins describes an engine having four pseudo-elliptical rotors and also describes the basic geometry of the configuration. Hopkins also recognizes the problem of sealing such engines, as noted in the first object of the invention on page 1, column 1, lines 12 through 21 of his patent. However, Hopkins is silent on the subject of sealing means for such engines, and provides no solution for the sealing problem he recognizes.

Since such realization, a large number of subsequent patents have described various attempts to seal the planetary rotor engine. U.S. Pat. No. 3,439,654 issued on Apr. 22, 1969 to Donald K. Campbell, Jr., titled "Positive Displacement Internal Combustion Engine," describes a planetary rotor mechanism configuration similar to that of the Colbourne '756 U.S. Patent discussed above. Campbell, Jr. discloses tip seals within his rotors, but does not disclose any means of compensating for thermal dimensional changes in his engine, nor any means of sealing the ends of the rotors and the shafts in the case. The present invention accomplishes all of these sealing means, with the means for sealing the faces of the rotors against one another, serving to compensate for thermal dimensional changes of the rotors and case during operation of the machine.

U.S. Pat. No. 3,809,026 issued on May 7, 1974 to Duane B. Snyder, titled "Rotary Vane Internal Combustion Engine," describes a multiple rotor planetary rotor engine including sealing means between the rotors. The sealing means between rotors comprises floating strips of seal material having thickened opposite edges. The relatively thicker edges preclude the escape of the seals from between adjacent rotors, as the relatively thinner central area is pinched between adjacent rotors. The present invention does not utilize any sealing means which is invasive to the central working chamber of the machine, as is the case with the Snyder device. Snyder also discloses rotor end seals, which are of conventional configuration and unlike the seals of the present invention.

U.S. Pat. No. 3,883,277 issued on May 13, 1975 to Leonard J. Keller, titled "Rotary Vane Device With Improved Seals," describes an eccentric vane machine using double rollers between the distal ends of each pair of vanes in the case. As the vanes move inwardly and outwardly as they revolve eccentrically, the rollers provide the proper geometry for the vanes and also seal the distal ends of the vanes. Thus, the roller sealing means define one end of each working chamber between each adjacent vane, whereas the sealing means for adjacent rotors of the present invention, does not involve any structure within or forming a part of the working chamber of the machine. Keller is silent regarding any sealing means between the ends of the vanes and the inner walls of the case, which sealing means are provided in the present invention.

U.S. Pat. No. 3,990,410 issued on Nov. 9, 1976 to Ehud Fishman, titled "Rotary Engine With Rotary Valve," describes an engine configuration having three generally triangular shaped planetary rotors, somewhat similar to one of the embodiments of the Delamere '341 U.S. Patent discussed further above. Fishman teaches sealing between adjacent rotors by means of hinged, outwardly biased seals extending about half way along each face of each of the rotors. Each seal bears against an unsealed portion of an adjacent rotor during rotation. Whereas the present sealing means could be applied to such generally triangular rotor planetary rotor devices as disclosed in the Fishman and Delamere U.S. Patents, it is not invasive to the working chamber of the machine, unlike the sealing means used in the machines of Fishman and Delamere. It is also noted that Fishman does not disclose any sealing means for the ends of his rotors, nor for the shaft exiting the case, as provided by the present invention.

U.S. Pat. No. 4,934,325 issued on Jun. 19, 1990 to Duane B. Snyder, titled "Rotary Internal Combustion Engine," describes a planetary rotor engine similar to those machines described in the U.S. Patents to Colbourne, Homan, Hopkins, Delamere, Campbell Jr., and Snyder, discussed above. The Snyder '325 Patent discloses a rotor sealing means similar to that disclosed in U.S. Pat. No. 3,809,026 to the same inventor, but using tension springs to bias the seals outwardly at all times. The seals are invasive into the working chamber of the machine, unlike the non-invasive seals used in the planetary rotor engine sealing means of the present invention.

U.S. Pat. No. 4,968,234 issued on Nov. 6, 1990 to Dietrich Densch, titled "Rotary Piston Machine With Sealing Elements," describes a three planetary rotor machines with the rotors each having an arcuate triangular shape, as in one of the embodiments of the Delamere U.S. Patent and of the Fishman U.S. Patent, both discussed above. Densch discloses an invasive sealing means between rotors essentially like that disclosed by Snyder in his '026 U.S. Patent, discussed above.

U.S. Pat. No. 5,271,364 issued on Dec. 21, 1993 to Duane P. Snyder, titled "Rotary Internal Combustion Engine," describes a planetary rotor engine similar to that disclosed in U.S. Pat. No. 4,934,325 to the same inventor, and discussed above. However, the rotor-to-rotor sealing means of the later '364 U.S. Patent is different from the invasive vane seals disclosed earlier, and comprise a plurality of flexible wiper strips disposed along one of the minor diameters or apices of each of the rotors. The present invention does not require any specialized or particular sealing means disposed on or between the rotor faces, as the sealing is accomplished by careful control of the spacing between adjacent rotors, which means is not disclosed by Snyder. Also, rotor end seals are disclosed, which are similar to the end seals described in the earlier '325 U.S. Patent to the same inventor. These end seals operate frictionally, unlike the rotor end seals of the present invention.

U.S. Pat. No. 5,341,782 issued on Aug. 30, 1994 to W. Biswell McCall et al., titled "Rotary Internal Combustion Engine," describes a planetary rotor configuration similar to those of the U.S. Patents to Colbourne, Homan, Hopkins, Delamere, Campbell Jr., and Snyder, discussed above. A different valve means is disclosed, which is beyond the scope of the present invention comprising sealing means for such machines; the present sealing means may be used with the McCall et al. and any of the other planetary rotor machines of record. McCall et al. disclose rotor end seals comprising circumferential rings which bear against the adjacent inner surface of the case. The present invention is different, in that the rotor end seal means does not bear frictionally against the adjacent case wall or surface.

Thus, as can be seen with respect to planetary rotor engines, seals for the plurality of moving rotor faces are generally invasive, and thus a first dynamic seal is needed to seal potential gaps as the rotor face surface translates across varying spatial coordinates to constantly reform the contact between a plurality of moving rotor surfaces and thereby define an enclosed combustion volume. Second, a second dynamic seal is needed and desired to effectively seal the end space to minimize the effect of alternating pulses leaking between the end space formed between the rotor end and the case. Third, a third dynamic seal is needed and desired around the centershaft to minimize the adverse pulse effects and increase life by decreasing frictional thermal and wear conditions during low-pulse conditions (i.e. when high sealing forces are less necessary).

None of the above inventions and patents, taken either singly or in combination, is seen to describe the instant invention as claimed.

SUMMARY OF THE INVENTION

The present invention comprises various methods and means of sealing a planetary rotor engine which allows the engine to achieve its theoretical and practicable efficiency. The present invention solves each of the three main problem areas identified above.

A first method and resulting dynamic seal for sealing the rotor face surfaces as they translate across varying spatial coordinates to constantly reform the contact between each other and thereby define an enclosed combustion volume includes the key step of moving the shaft centerlines of each of the rotors, thereby radially positioning the rotors along diametric axes at positions which compensate for varying thermodynamic conditions (i.e. farther apart or closer together, for example, due to thermal expansion or contraction of rotor materials). The first dynamic seal is thus formed solely from the contact pressure between moving surfaces, which pressure is maintained constant throughout the operational cycle of the planetary rotor engine, i.e. from cold to hot and through each intake and exhaust cycle. Various mechanisms are described which permit movement of the shaft centerlines along the diametric axes and automatically compensate for such thermodynamic changes.

A second method and resulting dynamic seal for effectively minimizing leakage between the end space formed between the rotor end and the case includes the key step of introducing a surface depression or hollow of any shape on one, or both, of the rotor end and opposing casing, thereby eliminating the need for a frictional seal and, in essence, forming a pressure wave plug. The effect of such depressions is to reduce the magnitude of the change between pressure and vacuum conditions which occur in the combustion volume but leak into and through the end space. Pursuant to the Bernoulli principle (which states, generally, that as a fluid passes through an increased volumetric space, the velocity of the fluid decreases and the lateral pressure increases) a pressure oscillation or wave is created through the modified gap, which in turn dissipates kinetic energy, and thus minimizes damage to the centershaft seal area.

Third, a third method and resulting dynamic seal for sealing around the centershaft takes advantage of and is responsive to the changes in pressure and partial vacuum pulses during the operation cycles of the engine. A seal is described which has a configuration adapted to seesaw in correspondence with positive and negative pressure changes over a single pressure wave, but increasingly bears against the adjacent inner wall of the rotor case under increasing amplitudes of successive pressure/vacuum pulses, thus being automatically responsive to the changes between pressure and partial vacuum in correlation with operational efficiency of the engine. However, when wave amplitude is low or near zero, the seal acts as a low-friction seal without seesawing.

The third dynamic seal (one embodiment termed herein an "annular pivot and lever seal"), comprises a specially configured annulus for surrounding the centershaft having, generally described, a pivotal H-shaped cross section (or a "mirror image seesaw"). At rest, the seal resembles an annular prismatic H, the prismatic H being joined end to end and thereby defining opposing annular discs pivotally and joined by a cylinder. Each annular disc includes an internal structure, radially divided into an annular arrangement of a plurality of individual levers (which correspond in cross section to each leg of the H), each end of the cylinder thus acting as the fulcrum for each lever. Under rapidly alternating positive and negative pressure conditions, opposing levers seesaw in mirror image with one another, the angular amplitude of each lever proportionally corresponding in magnitude to the amplitude of the pressure wave. Thus, frictional thermal and wear conditions during low-amplitude pulse conditions (i.e. when high sealing forces are less necessary), are reduced; likewise, when high sealing forces are required, the seal is able to react accordingly.

Accordingly, it is a principal object of the invention to provide improved sealing methods for planetary rotor engines, including means for providing a precise fit between adjacent rotors to substantially eliminate any clearances therebetween under all operating conditions.

It is another object of the invention to provide an improved sealing method for planetary rotor engines, wherein the method for providing a precise fit between rotors may comprise thermal control by selectively heating and/or cooling stationary internal components of the engine, in order to provide stable dimensions for the components of the engine.

It is a further object of the invention to provide an improved sealing method for planetary rotor engines, wherein the method for providing a precise fit between rotors may comprise mechanical, electrical, pneumatic, and/or hydraulic adjustment of the radial offset between rotors.

An additional object of the invention is to provide an improved sealing method for rotary displacement engines, comprising rotor end seals which do not frictionally engage the adjacent inner walls of the case of the engine.

Still another object of the invention is to provide an improved sealing method for the shafts of rotary displacement engines, comprising a double acting seal serving to seal pressure and partial vacuum pulses from the engine.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various methods and means of sealing a planetary rotor engine, in order to provide the required efficiency for such an engine. A discussion of the methods used to accomplish this goal precedes each of the various embodiments and means described in the Figures.

Figure 1:
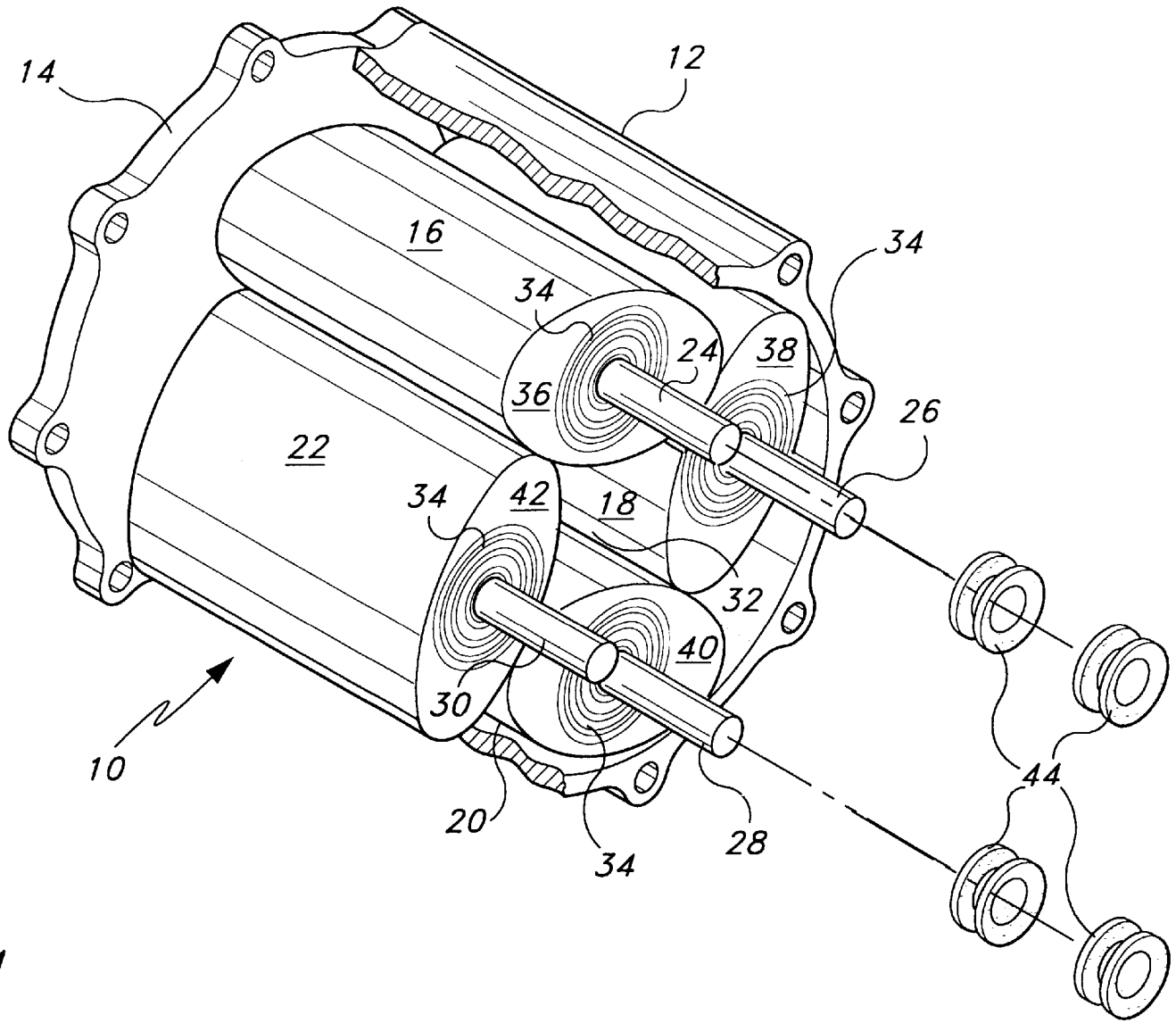
FIG. 1 is a partially broken away perspective view of a planetary rotor displacement engine, showing the disposition of the rotors therein and rotor end and shaft sealing means.
Figure 10:
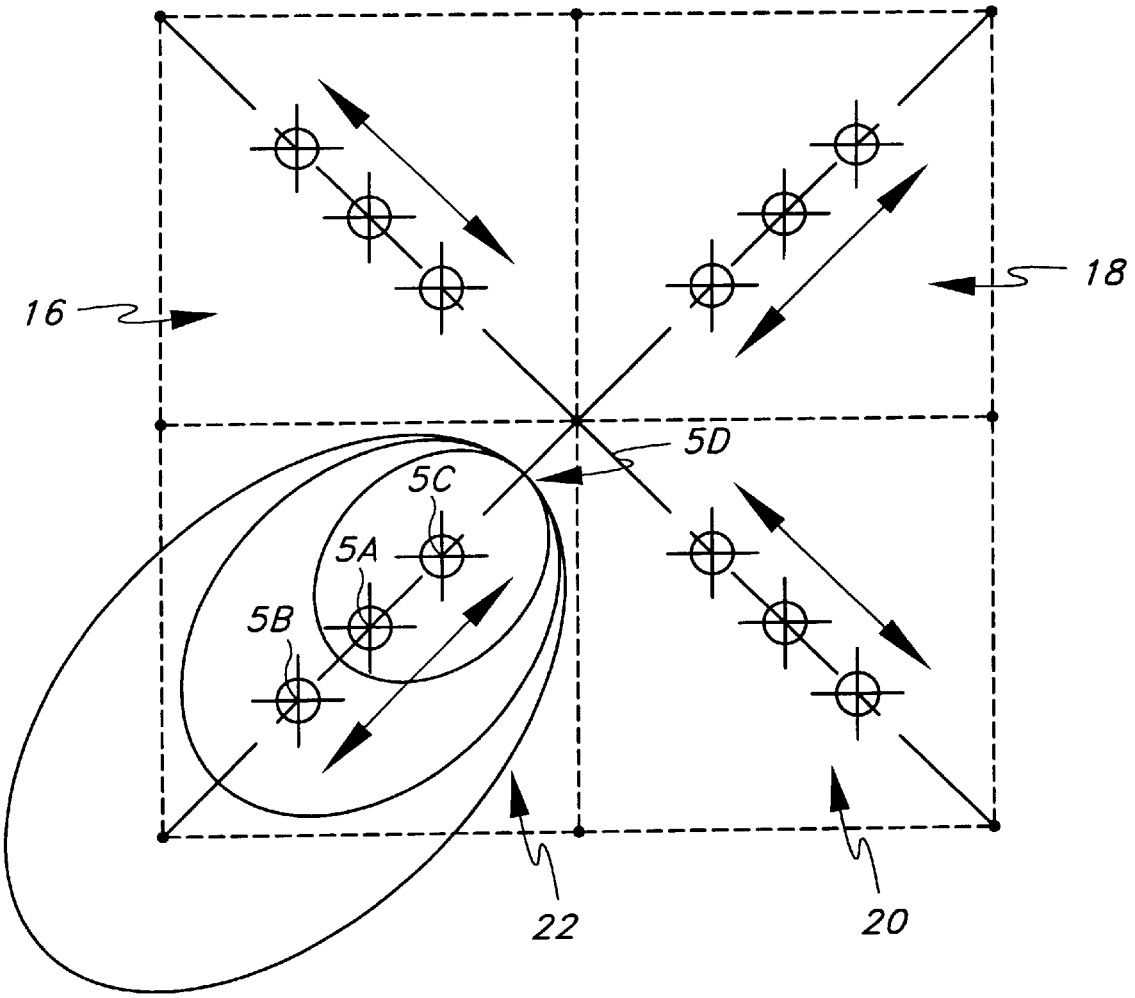
FIG. 10 is a diagrammatic view represents a highly exaggerated change in position of the rotor shaft centerlines and the method used to effect the seal between the faces of the rotors.

With reference to both FIG. 1 (which in part illustrates a broken away perspective view of a planetary rotor internal combustion engine 10) and FIG. 10 (which diagrammatically represents a highly exaggerated view of the method used to effect the seal), the first method is shown to result in a first dynamic seal for sealing the rotor face surfaces as they translate across varying spatial coordinates in order to constantly reform the contact between each other and thereby define an enclosed combustion volume.

The machine 10 includes a generally cylindrical case 12, with a first end wall 13 (shown in FIG. 5) and second end wall 14, which is essentially a mirror image of the first wall. A plurality of planetary rotors 16, 18, 20, and 22 are assembled on a like number of shafts, respectively 24, 26, 28, and 30, which extend through the case 12 between the first wall and second wall 14 and define the axial centers of the rotors. Each of the rotors 16 through 22 rotates about its respective shaft, with all rotors rotating in the same direction at the same rotational velocity or rpm. The rotors each have a pseudo-elliptical shape formed by opposite arcuate quadrants having relatively large radii, with opposite arcuate quadrants of relatively smaller radii joining the larger quadrants.

The above described rotor shape and rotation results in the curved faces of the immediately adjacent rotors, e.g., rotors 16, 18, and 22, rotors 18, 20, and 22, etc., being in sliding contact with one another when the engine is properly assembled and adjusted. This mutual contact between adjacent rotor faces results in a closed central working chamber 32 which periodically varies its volume according to the rotation and relative movement of the rotors, expanding and contracting twice per complete revolution of each of the rotors 16 through 22. The above described engine 10 is considerably simplified, with gearing, drive output means, valve means, ignition means, etc., not shown in the drawings; these features are old in the art, and different variations of each are disclosed in the prior art discussed further above.

However, such planetary rotor engines cannot function efficiently (if at all) without adequate sealing means between the adjacent rotor faces, the rotor ends and the adjacent plates or ends of the case, and at the rotor shafts. Referring now to FIG. 10, the principle and key step of the inventive method includes moving the shaft centerline 5A from a center position (e.g. as factory installed at 70 degrees room temperature) backward or forward to centerline positions 5B and 5C, thereby radially positioning the rotors along diametric axes at positions which compensate for varying conditions. Such conditions may include thermodynamic changes or material changes, such as, for example, thermal expansion or contraction of rotor materials and wear of the rotor surfaces.

The tolerances of axial movement to compensate for changes are in the micrometer range. However, FIG. 10, in highly exaggerated view, shows the method by which the first dynamic seal is formed, the seal of the rotor faces as shown in FIG. 1 arising solely from the contact pressure between moving surfaces of the rotor faces. The axial movement is diagrammatically represented in quadrants in which, for example, four rotors, 16,18,20,22 lie. In order for the face of rotor 22 to maintain a constant pressure against an associated rotor face at a predetermined point, identified as position 5D, the position of centerline 5A must move with material expansion to position of centerline 5B, and must move with material contraction to position of centerline 5C. Likewise, material wear may be corrected in this manner.

Figure 6:
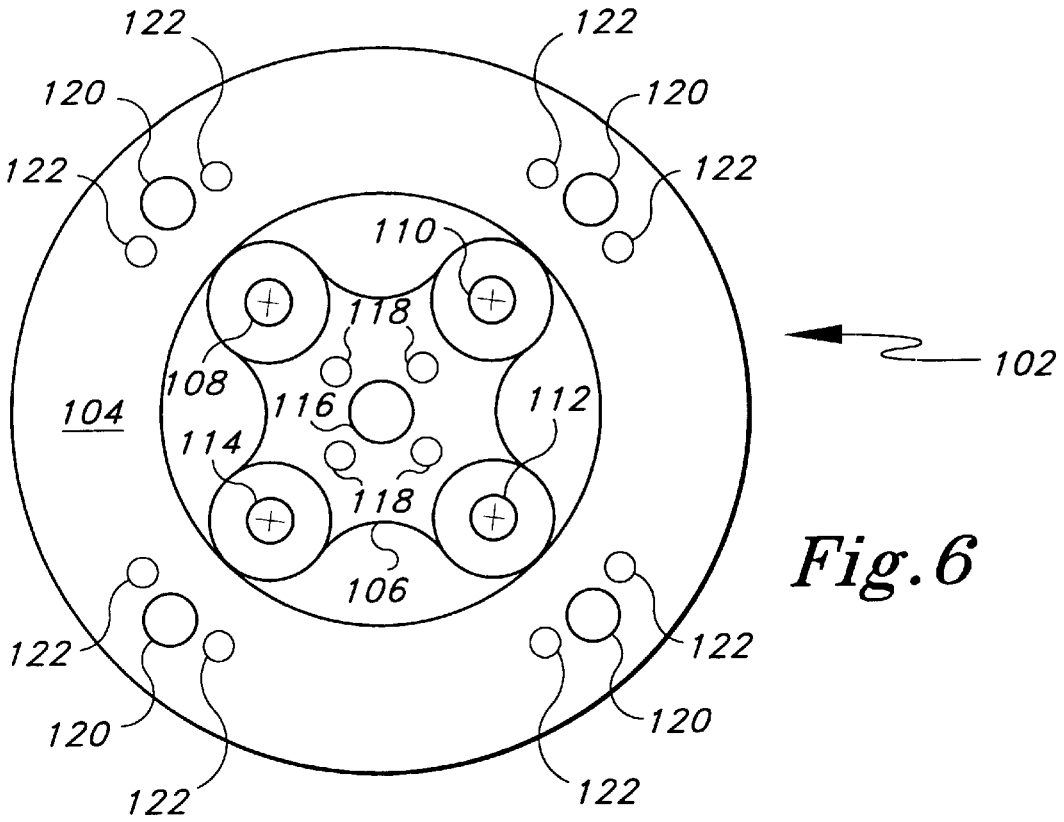
FIG. 6 is a view of an internal mounting retainer for the rotor shafts of a planetary rotor displacement engine, showing heating and cooling passages therethrough for thermally adjusting the centerlines of the rotor shafts at radial positions relative to the rotor ends.
Figure 7:
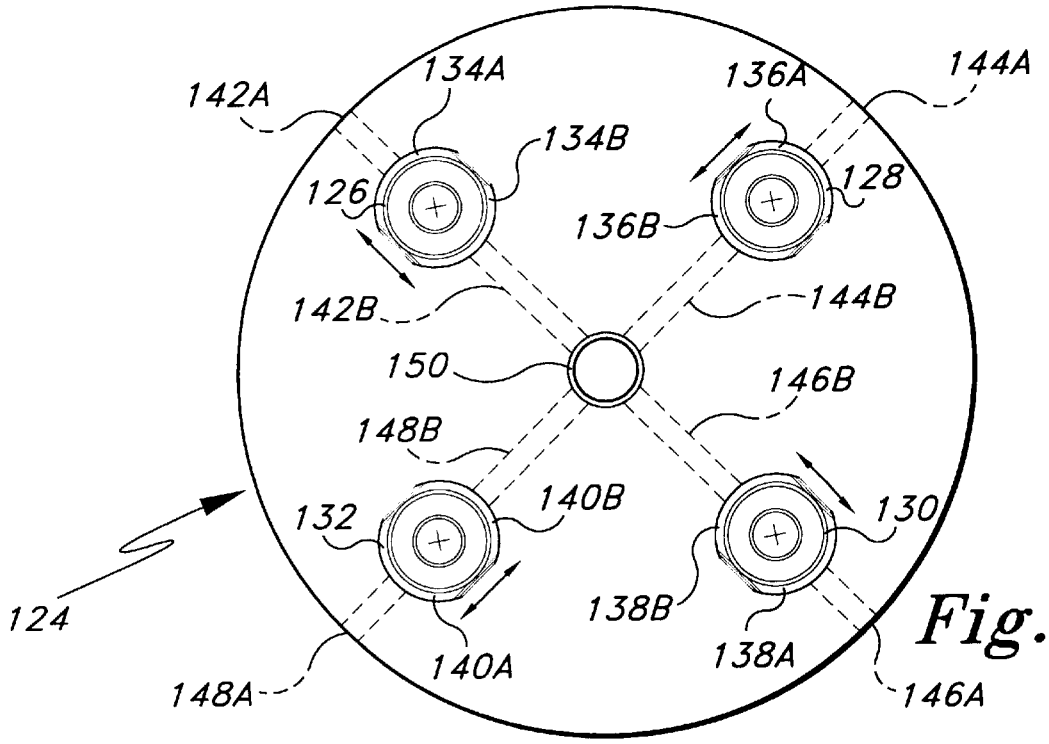
FIG. 7 is a view of another shaft mounting retainer mechanism, showing fluidic shaft position adjustment means.
Figure 8:
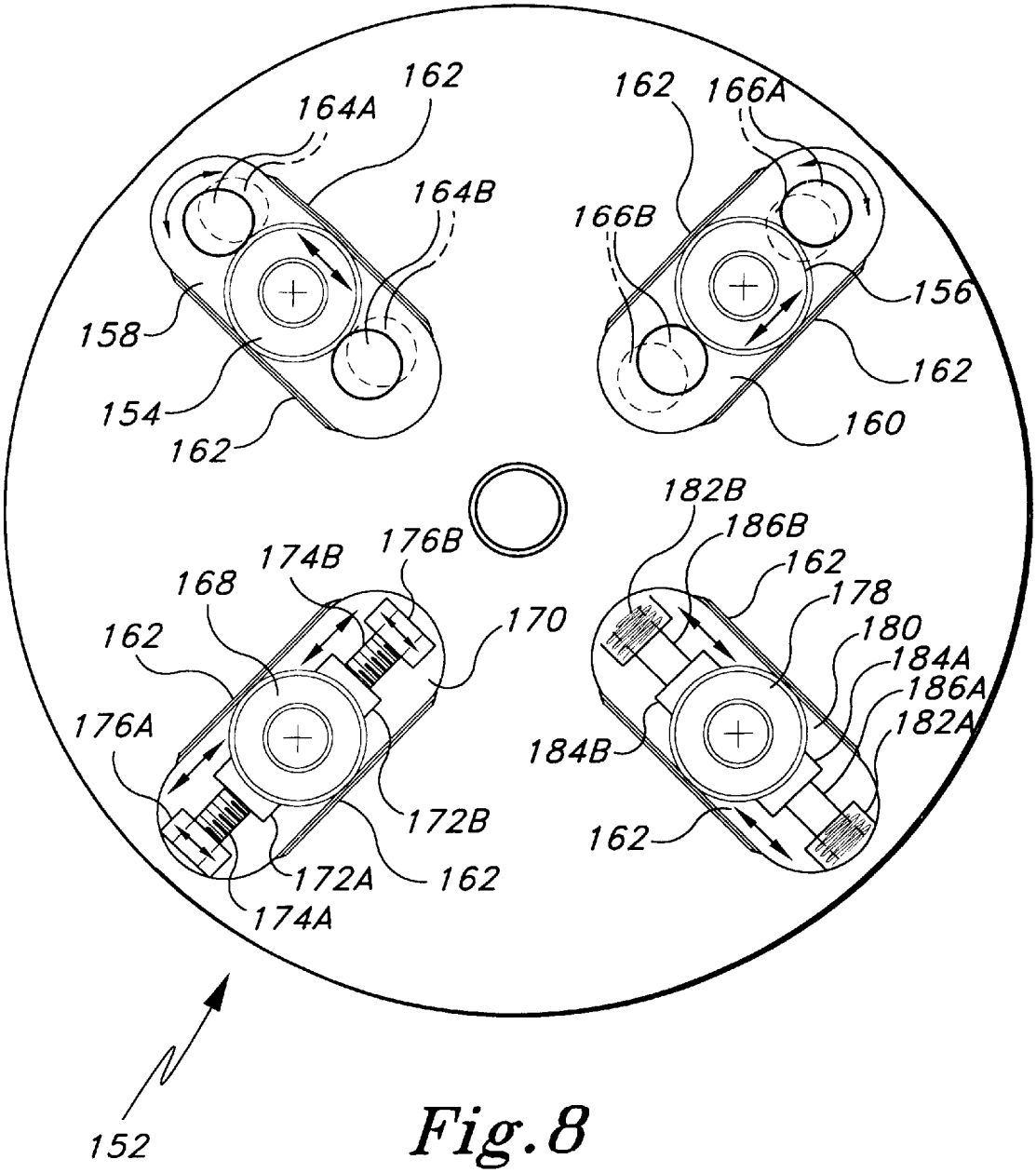
FIG. 8 is a view of yet another shaft mounting retainer mechanism, showing various shaft position adjustment means including mechanical cam adjustment, threaded adjustment, and electrical solenoid adjustment for positioning the rotor shafts.

Accordingly, FIGS. 6 through 8 of the present disclosure provide various means of precisely positioning the rotors of such an engine relative to one another, so the faces of adjacent rotors are always in sliding contact with one another to preclude any significant flow of gases therebetween, thereby forming the first dynamic seal.

Generally described, a first means for effecting such axial movement includes a rotor shaft which is set in an axial slots. FIG. 6 provides a generalized schematic view of a rotor support end plate 102 which could be used as one of the two end plates, e.g., end plates 13 and 14 respectively of FIGS. 5 and 1, for the support and adjustable positioning of the rotors. The plate 102 includes an outer portion 104 and an opposite, concentric inner portion 106, with the inner portion 106 having a plurality of rotor attachment means, such as the four journals or holes 108, 110, 112, and 114, for a corresponding number of rotor shafts, e.g., the rotor shafts 24 through 30 of the mechanism 10 of FIG. 1.

Both the inner portion 106 of the plate 102, carrying the shaft holes or journals 108 through 114, and the surrounding outer portion 104 of the plate, include a plurality of heating and cooling passages therein or therethrough. The inner portion 106 includes at least one heating passage 116 and at least one cooling passage 118 (and preferably additional passages, for symmetrical placement and thereby symmetrical thermal expansion and contraction). In the plate 102 of FIG. 6, a single heating passage 116 is provided in the precise center of the inner portion 106, with a plurality of equally spaced cooling passages 118 corresponding to the number of shaft journals 108 through 114, disposed between the central heating passage 116 and the journals.

The outer portion 104 of the plate 102, includes a plurality of heating passages 120 and cooling passages 122 therein or therethrough. As in the case of the inner portion 106 of the plate 102, preferably the outer heating and cooling passages

120 and 122 are preferably symmetrically placed relative to the four journals or holes 108 through 114, in order to provide symmetrical thermal control of the expansion and contraction of the plate 102. It will be seen that other arrangements may be provided, e.g., circumferential concentric heating and cooling passages, etc., in order to move the shaft centerline.

Precise dimensional control of the radial positions of the journals or holes 108 through 114, and thereby the centerlines of the shafts journaled in those passages 108 through 114, is provided by selectively passing a heated fluid or a coolant through the respective heating passages 116 and 120 or cooling passages 118 and 122, as required. For example, if the internal rotor mechanism is relatively cool, with the rotors having contracted to provide an excessive clearance therebetween, coolant may be passed through the cooling passages 118 of the inner portion 106 of the plate 102, thereby causing the inner portion 106 to contract and draw the four shaft journals or holes 108 through 114 and shafts journaled therein, closer together. A similar action occurs when coolant is passed through the cooling passages 122 of the outer portion 104 of the plate 102, causing the outer portion to shrink slightly and further urging the shaft journals 108 through 114, and thus their shafts and rotors attached thereto, closer together.

When the internal components have been heated through operation and their adjacent clearances are too tight, further clearance may be gained by passing a heating fluid through the heating passage(s) 116 of the inner portion 106 and passages 120 of the outer portion 104 of the plate 102. This results in the inner portion 106 expanding, thereby very slightly increasing the radial distances of the four shaft journals 108 through 114 from the center of the plate 102, and expanding the outer portion 104 as well for further clearance. Other heating means (electrical, flame tubes, engine exhaust, etc.) may be used alternatively, in lieu of heated fluids.

FIG. 7 illustrates another means of adjusting the rotor shafts, by moving the rotor shaft centerlines radially inwardly or outwardly as required. In FIG. 7, a rotor support end plate 124 includes a plurality of shaft journals defined by bearings 126, 128, 130, and 132. Each of the bearings 126 through 132 is slidably mounted within a radially elongate, oval shaped housing, with the sides of the housings providing a close fit for the bearings 126 through 132 by shims or other means as appropriate to preclude non-radial movement of the bearings 126 through 132, and thus the rotor shafts journaled in the bearings, and further to essentially seal the sides of the bearings to preclude fluid leakage therepast. As the housings are elongate, each housing has an outer volume, respectively 134*a*, 136*a*, 138*a*, and 140*a*, and an opposite inner volume, respectively 134*b*, 136*b*, 138*b*, and 140*b*, for the four bearings 126 through 132. (Each of these spaces 134*a* through 140*b* need not be particularly large, as they need only adjust the rotor spacing for thermal expansion and contraction and some slight amount of wear in the mechanism as it occurs.)

A series of radially disposed fluid chambers is provided in the plate 124, with a plurality of outer chambers 142*a*, 144*a*, 146*a*, and 148*a* communicating with the respective housing outer volumes 134*a* through 140*a*, and inner chambers 142*b*, 144*b*, 146*b*, and 148*b* communicating with the respective housing inner volumes 134*b* through 140*b*. Fluids, e.g. pneumatic or hydraulic fluids, are passed through these chambers 142*a* through 148*b* to adjust the positions of the bearings 126 through 132 within their respective housings by providing opposing negative or positive pressure differentials to respective sides of the shaft centerline, thereby causing the centerline to be moved.

As an example of the operation of the above described adjustment means, if the internal mechanism is relatively cool, thus resulting in a relatively large clearance between each of the adjacent rotors, then a fluid (hydraulic fluid, pressurized gas, etc.) having a relatively higher pressure is applied to the outermost radial chambers 142*a*, 144*a*, 146*a*, and 148*a*, with fluid under a lesser pressure remaining within the corresponding inner chambers 142*b*, 144*b*, 146*b*, and 148*b*. The relatively higher pressure fluid within the outermost chambers enters the outer portions 134*a*, 136*a*, 138*a*, and 140*a* of the bearing housings, thus causing each of the centerlines passing through bearings 126–132 to move somewhat inwardly toward the opposite side of the housing, due to the relatively lower pressure within the inner chambers 142*b*, 144*b*, 146*b*, and 148*b*, and the corresponding inner portions 134*b*, 136*b*, 138*b*, and 140*b*, with which those inner chambers communicate.

In the event that the rotor clearances are too tight, a relatively higher pressure may be applied within the inner chambers 142*b*, 144*b*, 146*b*, and 148*b*, than to the outer chambers 142*a*, 144*a*, 146*a*, and 148*a*, thus causing the centerlines passing through bearings 126–132 to move outwardly within their respective housings. Fluid flow to and from the outer chambers 142*a*, 144*a*, 146*a*, and 148*a* may be provided by a manifold (not shown) which communicates with those outer chambers, and flow to and from the inner chambers 142*b*, 144*b*, 146*b*, and 148*b* may be provided by a central port or passage 150.

FIG. 8 discloses further rotor spacing adjustment means, comprising various mechanical and electrical adjustment means. (It will be understood that while it is possible to include these and other different adjustment means in a single mechanism, that preferably a single mechanism would incorporate only a single type of adjustment means. The various adjustment means disclosed in the single rotor support end plate 152 of FIG. 8, are shown in the single drawing FIG. 8 in order to simplify and reduce the total number of drawing figures.)

The uppermost bearings 154 and 156 of the plate 152 of FIG. 8, are radially adjusted by mechanical means comprising cams or eccentrics. A radially elongate housing, respectively 158 and 160, is provided for each of the bearings 154 and 156. The bearings 154 and 156 are slidably adjustable radially within their respective housings 158 and 160, but are precluded from non-radial movement by the closely fitting sides of the housings 158 and 160, which may incorporate shims 162 to provide a proper lateral fit for the bearings 154 and 156.

Each bearing housing 158 and 160 includes an outer cam or eccentric, respectively 164*a* and 164*b*, and an opposite inner cam or eccentric, respectively 166*a* and 166*b*, with the bearings being captured or sandwiched between their respective inner and outer cams. Selectively and cooperatively rotating the cams 164*a* through 166*b* as required, results in radial movement of the bearings 154 and 156 within their respective housings 158 and 160, as described below.

The upper left bearing 154 and its housing 158 illustrate a situation wherein the bearing 154 is disposed at an intermediate position, neither fully retracted away from nor fully extended toward the center of the plate 152. Two alternate positions are shown for each of the cams 164*a* and 164*b*, with a first position for each cam shown in solid lines, and a second position shown in broken lines. It will be seen that these two alternate positions for each cam 164*a* and 164*b*, result in each of their contact points or surfaces against the bearing 154 being equidistant from the center of the housing 152, thus resulting in a generally central disposition for the bearing 154.

If a greater clearance for the rotors was required, then the cams could be rotated approximately 90 degrees clockwise (relative to the elongate axis of the housing) from the solid line positions shown for the cams 164*a* and 164*b*, to position them in the manner of the cams 166*a* and 166*b* (shown in solid lines) for the upper right bearing 156. With the cams 166*a* and 166*b* positioned as shown by the solid line showing in the housing 160 of FIG. 8, the bearing 156 is pushed radially outwardly from the center of the housing 152, thereby providing the additional rotor clearance required.

On the other hand, if a smaller clearance were to be required, the two cams 166*a* and 166*b* could be rotated 180 degrees from their solid line positions shown, to opposite positions shown in broken lines. This would cause the bearing 156 to be pushed inwardly toward the center of the housing 152. It will be seen that other mechanical means (levers, etc) could be used to achieve this movement.

The FIG. 8 lower left bearing 168 is adjusted by a different mechanical movement, using a threaded system. The bearing 168 is contained within a radially elongate housing 170, as in the other bearing housings discussed further above. Again, one or more shims 162 may be placed between the bearing 168 and the side walls of the housing 170, for precluding non-radial movement of the bearing 168. Outer and inner support blocks, respectively 172*a* and 172*b*, are positioned to each side of the bearing 168, sandwiching the bearing 168 therebetween. An outer and an inner threaded adjustment screw, respectively 174*a* and 174*b*, respectively bear against the outer and inner blocks 172*a* and 172*b*, to move the bearing 168 back and forth radially therebetween as required. Adjustment of the threaded adjustment screws 174*a* and 174*b* is accomplished by means of outer and inner adjusters, respectively 176*a* and 176*b*.

Thus, if greater clearance was required, the outer adjuster 176*a* would be rotated to draw the outer adjustment screw 174*a*, and thus the block 172*a* and bearing 168, outwardly, while the opposite inner adjuster 176*b* would be rotated to extend the inner adjustment screw 174*b* to push the bearing 168 outwardly. If movement of the bearing 168 in the opposite inward direction is required, the two adjusters 176*a* and 176*b* are turned in the opposite direction of that used to move the bearing outwardly, thus extending the outer adjustment screw 174*a* and retracting the inner adjustment screw 174*b*. While two adjustment screws 174*a* and 174*b* are shown, it should be noted that movement of the bearing 168 in both directions could be achieved by a single screw positively linked to the bearing.)

Yet another bearing adjustment means is disclosed for the lower right bearing 178 of FIG. 8, in which an electromechanical adjustment means is provided. Again, the bearing 178 is enclosed in a radially elongate housing 180, with shims 162 being provided as required for precluding non-radial movement of the bearing 178 within the housing 180. An outer and an inner electrical solenoid, respectively 182*a* and 182*b*, are provided at each end of the housing 180, sandwiching the bearing 178 therebetween. (Outer and inner blocks 184*a* and 184*b* may be provided between the respective solenoid shafts 186*a* and 186*b*, in the manner of the outer and inner blocks 172*a* and 172*b* of the threaded adjustment means for the lower left bearing 168 of FIG. 8.)

The bearing 178, and its corresponding rotor shaft journaled therein, may be adjusted radially inwardly and outwardly from the center of the plate 152, by selectively and cooperatingly extending and retracting the inner and outer adjustment solenoids 182*a* and 182*b* as required. For example, if inward movement of the bearing 178 is required, electrical current may be applied to the inner solenoid coil 182*b* to attract the corresponding inner solenoid shaft 186*b*, and retract the shaft 186*b* inwardly. Current may be applied simultaneously to the opposite outer solenoid coil 182*a* to cause the solenoid shaft 186*a* to be repelled from the coil, thus driving the bearing inwardly as required. Electrical current of opposite polarity applied to both solenoid coils, will reverse the forces applied, thus extending the inner shaft 186*b* and retracting the outer shaft 186*a* to move the bearing 178 radially outwardly.

Figure 9:
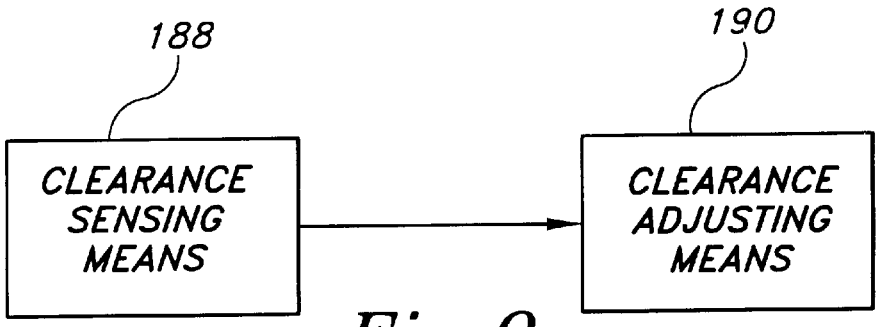
FIG. 9 is a block diagram showing the relationship between the clearance sensing means and clearance adjusting means for positioning the rotors within the engine.

All of the above described means for radially adjusting the positions of the rotor shaft bearings, require some means of sensing the clearances between adjacent rotors and activating the appropriate adjusters. This relationship is shown very generally in FIG. 9, where a clearance sensing means 188 provides a signal to a clearance adjusting means 190 (e.g., any of the clearance adjusting means shown in FIGS. 6 through 8 and discussed above), to position the bearings (and their respective shafts and rotors) accurately. The clearance sensing means may be any of a number of devices, such as an oxygen sensor for determining the quantity of blowby gases if rotor clearances increase, to computer algorithms for predicting the changes in rotor clearances as the operating temperatures of the various components of the mechanism change during operation and in accordance with ambient temperatures and conditions. Whichever clearance sensing means is used, it is important that it operate accurately and consistently to continually adjust the clearances of the bearings (and thus the shaft centerlines and their rotors) to essentially eliminate any gaps between adjacent rotors, for optimum efficiency.

Thus, as can be appreciated from the means and method described for providing a first dynamic seal between rotor faces provides an accurate and practicable means for solving the major problem with such mechanisms in the past, which has not permitted their development to progress. Attention is now shifted to the second of the aforementioned problems.

A second method and resulting dynamic seal for effectively minimizing leakage between the end space formed between the rotor end and the case includes the key step of introducing a surface depression or hollow of any shape on one, or both, of the rotor end and opposing casing, thereby eliminating the need for a frictional seal and, in essence, forming a pressure wave plug. The effect of such depressions is to reduce the magnitude of the change between pressure and vacuum conditions which occur in the combustion volume but leak into and through the end space. The Bernoulli principle is applied which states, generally, that as a fluid passes through an increased volumetric space, the velocity of the fluid decreases and the lateral pressure increases. Thus, a pressure oscillation or wave is created through the modified gap, which in turn dissipates kinetic energy, and thus minimizes damage to the centershaft seal area.

Figure 2:
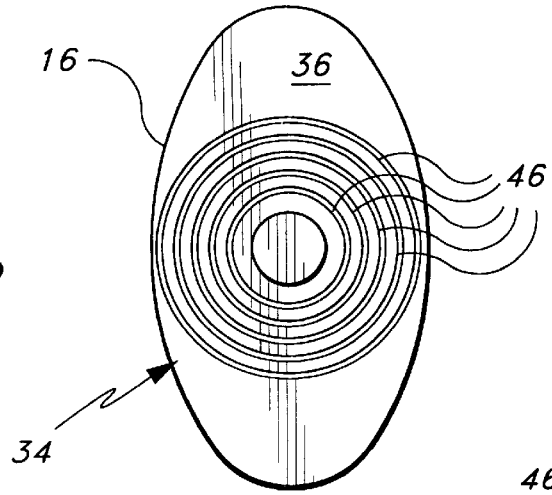
FIG. 2 is an end view of a rotor of the engine of FIG. 1, showing the end seal configuration thereof.

Momentarily referring to FIG. 1, a frictionless rotor end seal means, is indicated generally as seal means 34 disposed within the rotor ends, respectively ends 36, 38, 40, and 42. The rotor seal means are disposed between the rotor, e.g. rotor 16, and adjacent end wall of the case, e.g., a first end wall 13, shown in FIG. 5) and defining an end seal area 45 therebetween. FIGS. 2 through 3C provide detailed views of one embodiment of the rotor end sealing means 34 which arises from application of the described method (such means disclosed generally in FIG. 1). In FIG. 2, the end of a rotor, e.g., the first rotor 16 and its end 36, are shown, with a plurality of sealing grooves 46 formed concentrically about the rotor shaft 24. As noted, it shall be understood that the grooves shown may be dimples, channels, holes, notches, depressions, concavities, cavities, or any other type of hollow which defines a surface irregularity, preferably, annularly and serially concentrically placed on the rotor end or opposing case surface. These sealing grooves 46 are inset into the end 36 of the rotor 16, and serve to dissipate and attenuate differential pressure pulses which pass from the working chamber 32 of the engine 10, outwardly past the rotor end 36 during operation of the engine 10.

As a pressure pulse expands across the working chamber 32 and advances between the rotor end 36 and the immediately adjacent end wall, e.g., end wall 14 of FIG. 1, the pressure pulse encounters the first or outermost of the sealing grooves and expands, thereby dissipating its energy. While the gas within this extremely narrow space defined by the end wall of the engine and the rotor end is still at a relatively high pressure in comparison to the external environment, the pressure has been reduced due to the expansion within the first or outermost groove. Thus, the gas has less energy to penetrate the relatively narrow space defined by the end wall and the rotor end, between the outermost and next inward groove. It will be seen that pulses of relatively low pressure (partial vacuum) are affected in a similar manner, with the grooves acting to attenuate the pressure differential, whether it be positive or negative, and thus provide a sealing effect for the working chamber of the engine 10.

Figure 3A:
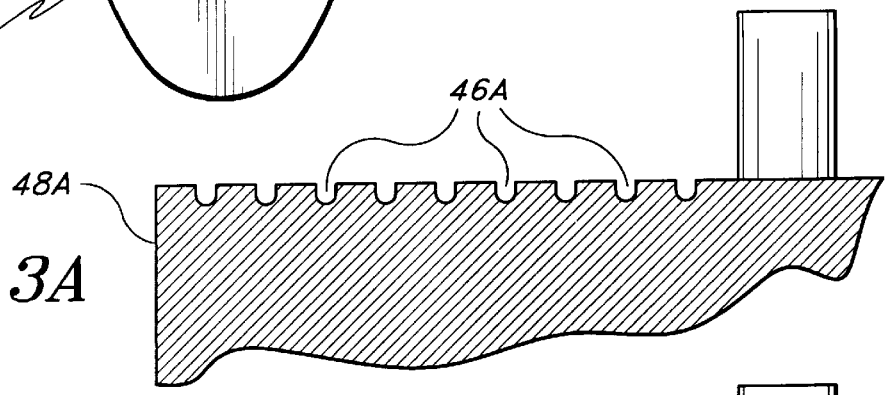
FIG. 3A is a cross sectional view of one embodiment of the rotor end sealing means shown in FIG. 2, showing semicircular seal grooves.
Figure 3B:
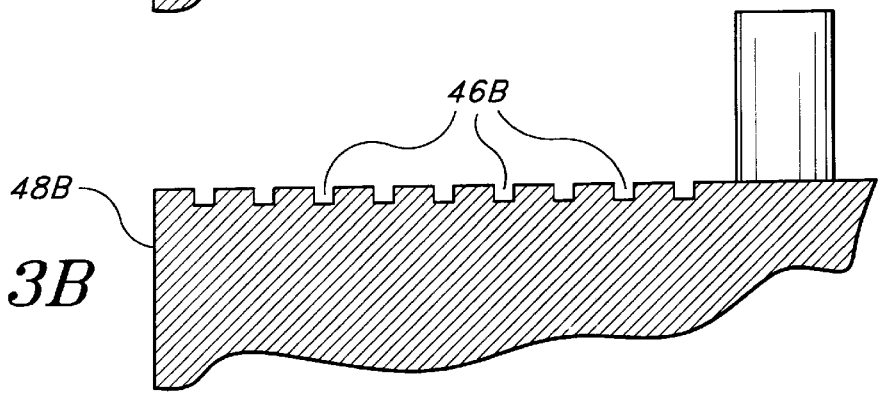
FIG. 3B is a cross sectional view of a second embodiment of the rotor end sealing means shown in FIG. 2, showing rectangular seal grooves.
Figure 3C:
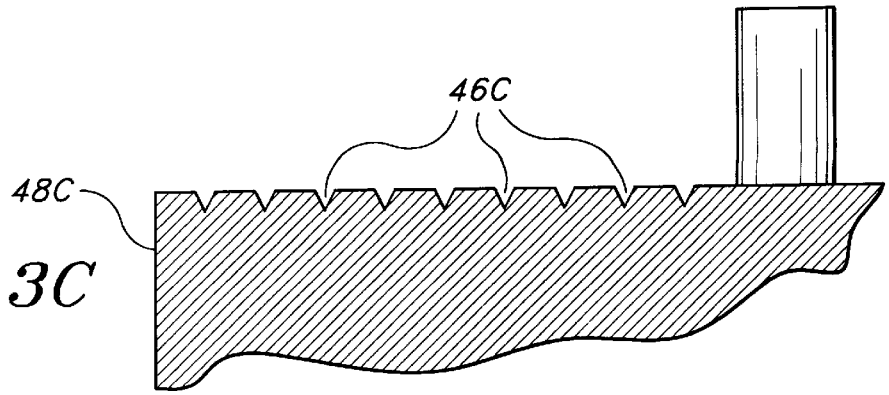
FIG. 3C is a cross sectional view of a third embodiment of the rotor end sealing means shown in FIG. 2, showing triangular seal grooves.

FIGS. 3A through 3C provide cross sectional views of different groove shapes which might be used as the present rotor sealing method of a planetary rotor internal combustion engine. In FIG. 3A, the grooves 46*a* have a semicircular or U-shaped cross sectional configuration, while FIG. 3B provides grooves 46*b* having a rectangular cross sectional configuration. FIG. 3C provides yet another groove configuration, in which the grooves 46*c* each have a triangular or V-shaped configuration. The precise groove configuration desired in any particular application depends upon many factors, such as the displacement rate of the engine, size and spacing of the grooves, etc. Also, while only three specific cross sectional groove shapes are shown, it will be seen that other groove shapes (trapezoid, elliptical, etc.) may be provided as appropriate, or, as stated above, any "negative" space, i.e. depression or hollow.

It will also be seen that while the non-frictional differential pressure damping or attenuating seal means 34 of FIGS. 1 and 2 are shown disposed in the ends of the rotors, that they may also be placed within the end walls of the engine case instead of or in addition to placement in the end of the rotors. While FIGS. 3A through 3C provide views of different shapes of grooves, the components of FIGS. 3A through 3C in which the grooves are formed, need not be rotors. The components 48*a* through 48*c* respectively of FIGS. 3A through 3C may represent the end walls of the mechanism, with the grooves 46*a* through 46*c* being formed about shafts defining the centers of rotation of the rotors.

Also, whereas multiple concentric grooves are shown in FIGS. 1 through 3C, a single hollow or depression will provide at least some of the desired effect discussed further above. Any practicable number of sealing depressions may be provided, but preferably a plurality of grooves (between four and ten concentric grooves) are provided, with each successive groove serving to dampen or attenuate an additional part of the pressure or partial vacuum pulse generated by operation of the mechanism. As can now be appreciated, such attenuation thus defines the second dynamic seal which will greatly increase the life of the centershaft seal. Nevertheless, an improved centershaft seal, the third dynamic seal, is provided and described next.

The third method and resulting dynamic seal for sealing around the centershaft takes advantage of and is responsive to those changes in pressure which are not attenuated by the second dynamic seal. This is due to a configuration adapted to seesaw in correspondence with positive and negative pressure changes over a single pressure wave, but increasingly bears against the adjacent inner wall of the rotor case under increasing amplitudes of successive pressure/vacuum pulses, thus being automatically responsive to the changes between pressure and partial vacuum in correlation with operational efficiency of the engine. However, when wave amplitude is low or near zero, the seal acts as a low-friction seal without seesawing.

Figure 4:
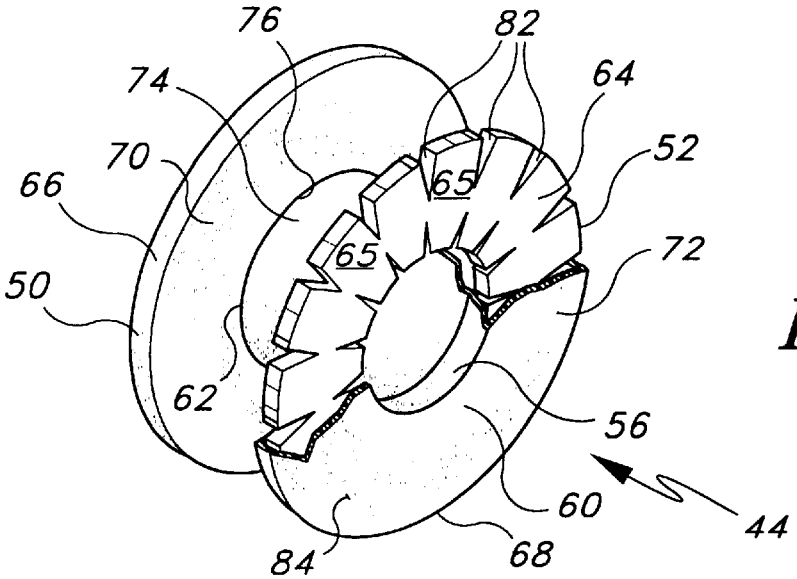
FIG. 4 is a partially broken away perspective view of a shaft seal according to the present invention, showing details of its construction.

This principle can be understood by examining an embodiment of the seal, herein the "annular pivot and lever seal" or "centershaft seal means", which comprises a specially configured annulus for surrounding the centershaft having, generally described, a pivotal H-shaped cross section (or a "mirror image seesaw"). Again momentarily referring to FIG. 1, the centershaft seal means is indicated generally as 44. A detailed view of a shaft seal 44 is shown in FIG. 4, with the operation of the shaft seal 44 being shown in the cross sectional view of FIG. 5. The shaft seal 44 comprises a first seal member 50 and an opposite second seal member 52, with each of the members 50 and 52 being toroidally shaped and having an inner edge, respectively 54 and 56, an inner portion, respectively 58 and 60, a plurality of internal, annularly arranged levers, respectively 62 and 64, an outer edge, respectively 66 and 68, and an outer portion, respectively 70 and 72. The two members 50 and 52 are spaced from one another, but joined together by a cylindrical third seal member 74 disposed between the first and second members 50 and 52, and flexibly joined thereto at their respective central portions 62 and 64 respectively by the first and second ends 76 and 78 of the third member 74.

Thus, at rest, the seal 44 resembles an annular prismatic H, the prismatic H being joined end to end and thereby defining opposing annular discs (toroids 50,52) pivotally and joined by cylinder 74, in the general form of a spool, with the outer edges 66 and 68 and outer portions 70 and 72 of the first and second members 50 and 52 serving as outer flanges of the spool shaped seal 44. This shape, although representative of the seal 44, is also a flexible casing for the internal working components responsive to pressure changes during operation of the representative embodiment.

Internally, the flat, toroidally shaped first and second seal members 50 and 52 include working components that are preferably formed of relatively thin and flexible material, e.g., spring steel or the like, in order to allow the seal 44 to pivot to conform to the casing to the differential pressures developed in the mechanism as described below. Each annular disc 50,52 is internally radially divided into an annular arrangement of a plurality of individual levers 65 (which correspond in cross section to each leg of the H), each end of the cylinder 74 thus acting as the fulcrum for each lever 65. Internal and external radial slits, respectively 80 and 82, are thus defined between levers 65 in the first and second seal members 50 and 52, with the inner slits 80 extending through the inner edges 54 and 56 and across the inner portions 58 and 60, and the outer slits 82 extending through the outer edges 66 and 68 and across the outer portions 70 and 72, respectively of the first and second seal members 50 and 52.

Thus, it can be understood that under rapidly alternating positive and negative pressure conditions, opposing plurality of levers 62,64 seesaw in mirror image with one another, the angular amplitude of each lever 65 proportionally corresponding in magnitude to the amplitude of the pressure wave. Thus, frictional thermal and wear conditions during low-amplitude pulse conditions (i.e. when high sealing forces are less necessary), are reduced; likewise, when high sealing forces are required, the seal 44 is able to react accordingly.

The casing is preferably a coating of an elastomer material 84, which forms a complete seal about the entire substructure of the seal 44 to preclude fluid flow about any of the edges thereof or through the slits 80 and 82. The elastomer material 84 may be molded or otherwise formed to have outwardly facing circumferential edges, respectively inner edges 86 and 88 of the first and second seal members 50 and 52, and outer edges 90 and 92 of the first and second members.

Figure 5:
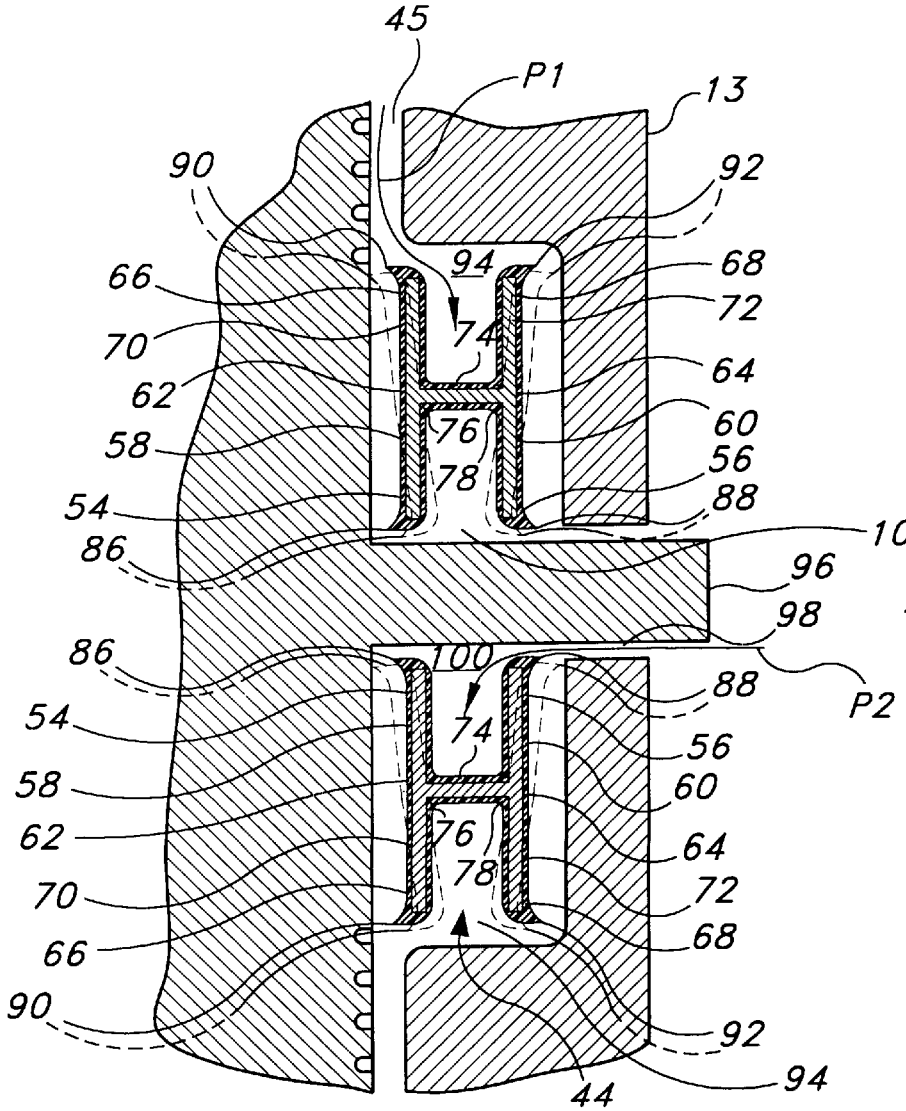
FIG. 5 is a detail cross sectional view of a portion of a rotary displacement engine, showing the shaft seal operation.

More specifically shown in FIG. 5, when a relatively high pressure is induced through the end seal gap 45 into the first sealing area 94 between the outer portions 70 and 72 of the first and second seal members 50 and 52, as indicated by the pressure arrow P1, the pivotal and flexible construction of the seal 44 allows the first and second seal member outer portions 70 and 72 to pivot apart, with the first outer circumferential edge 90 of the elastomer coating material 84 contacting the adjacent face of the rotating component, e.g., the front face of a rotor 16, and the opposite second outer edge 92 being spread to bear against the inner surface of the stationary component, e.g., the inner surface of the front wall or plate 13. Simultaneously, the inner edges 54 and 56 adjacent the rotating shaft, e.g., shaft 96 of FIG. 5, and their accompanying elastomer seal edges 86 and 88, are caused to correspondingly seesaw inwardly and away from the faces of the rotating and fixed components.

Whereas only the cross section of the seal 44 of FIG. 5 is shown experiencing this action, the action occurs about the complete circumference of the seal 44. The lower portion of the seal 44 of FIG. 5 is shown flexed in the opposite direction in order to demonstrate reversal of the scenario described above, although the seal 44 would not normally operate simultaneously in opposite directions, with the outer edges 66 and 68 being spread on one side of the seal, and the inner edges 54 and 56 being spread on the opposite side of the seal 44.

Conversely, when a negative pressure is generated within the combustion chamber, a positive pressure area is created between the shaft 96 and shaft passage 98 toward a second sealing area 100 defined by the seal inner portions 58 and 60, as indicated by the second pressure arrow P2. Thus, the relatively higher pressure between the second sealing area 100 and the negative pressure internal to the engine causes the two inner portions 58 and 60 of the seal 44 to pivot outwardly, thus causing the elastomer edges 86 and 88 to contact respectively the rotating component and fixed component of the mechanism, thereby sealing the mechanism and precluding further passage of external gas or fluid past the seal 44.

The above described action will be seen to provide a double action seal 44 responsive to both negative and positive pressure differentials, the third dynamic seal. In each of the above cases, it will be seen that only the elastomer edges of the pressurized portion of the seal 44, are urged against the adjacent components of the mechanism. The seal walls of the opposite, relatively low pressure portion, pivot toward one another, thereby removing any contact pressure from the adjacent walls of the mechanism and reducing friction during low amplitude pressure pulses.

While it is anticipated that one of the major applications for the present sealing means will be with a planetary rotor mechanism adapted for use as an internal combustion engine, the various embodiments of the present invention are not limited only to heat engines of various types, but also lend themselves to non-combustion applications, such as hydraulic and pneumatic motors and pumps, as noted further above. In whichever application the present seal means are applied, they will be seen to provide a significant advance in reducing leakage and internal friction, and thereby increasing the operational efficiency, of the displacement mechanisms to which they are applied. Therefore, it is to be understood that the present invention is not limited to the embodiments described above, but encompasses any and all embodiments within the scope of the following claims.

I claim:

1. A dynamic seal system for a planetary rotor engine having a casing, at least two end walls each having an inner surface and a plurality of internal rotors, each rotor having rotor ends and a rotor face, each said rotor mounted on a rotor shaft having a centerline and positioned to cause contact of adjoining rotor faces and thereby define a combustion chamber, further defining a gap between said rotor end and said casing, said dynamic seal system comprising:

at least one surface depression substantially forming an annulus covering and disposed on at least one of the group comprising the casing surface and the rotor end, said depression substantially changing the velocity of a fluid passing through the gap such that pressure and vacuum pulses passing between the ends of the rotor and the corresponding casing end walls of the machine during operation of the machine are attenuated;

means for adjustably positioning each centerline of said rotor shafts radially with respect to one another such that adjacent rotor faces are in sliding contact with one another at all times during operation of the engine, whereby leakage from the combustion chamber of the machine between said rotor faces in precluded;

means for sealing the rotor shaft including a plurality of annular fulcrum elements, a plurality of pivoting arms annularly disposed about each said annular fulcrum elements, and means for flexibly encasing said annular fulcrum elements and said respective pivoting arms, wherein said means for sealing the rotor shaft respectively surrounds each rotor shaft, disposed between the casing and each rotor face.

2. A dynamic seal system for a planetary rotor engine having a casing, at least two end walls each having an inner surface and a plurality of internal rotors, each rotor having rotor ends and a rotor face, each said rotor mounted on a rotor shaft having a centerline and positioned to cause contact of adjoining rotor faces and thereby define a combustion chamber, further defining a gap between said rotor end and said casing, said dynamic seal system comprising:

an annular fulcrum surrounding the rotor shaft;

a plurality of pairs of opposing pivot arms depending from the annular fulcrum and positioned between the casing and the rotor shaft;

means for adjustably positioning each centerline of said rotor shafts radially with respect to one another such that adjacent rotor faces are in sliding contact with one another at all times during operation of the engine, whereby leakage from the combustion chamber of the machine between said rotor faces in precluded; and at least one annular surface depression disposed in at least one of the casing surface end wall and each rotor end, each said annular surface depression changing the velocity of a fluid passing through a gap between the casing surface and the rotor end, whereby pressure and vacuum pulses passing between each rotor end and the end wall of the casing are attenuated.

3. The dynamic centershaft seal according to claim 2, wherein said plurality of pairs of opposing pivot arms define a first seal member and a second seal member, each toroidally shaped to define an inner edge and inner portion, an opposite outer edge and outer portion, and a central portion; and wherein said annular fulcrum is a cylindrical third seal member, having a first edge and an opposite second edge, said first edge of said third seal member being pivotally joined to said central portion of said first seal member, and said second edge of said third seal member being pivotally joined to said central portion of said second seal member, spacing said first seal member from said second seal member;

wherein a first sealing area between said outer portion of said first and said second seal member is defined, and a second sealing area between said inner portion of said first and said second seal member is further defined;

whereby when a pressure differential is applied to one said sealing area, said inner portion of said seal members is urged apart forcing said inner edge sealingly against the internal rotating component and the internal wall of the case.

4. The dynamic centershaft seal according to claim 3, wherein said first, said second, and said third seal member are joined by a coating of an elastomer seal material.

5. The dynamic centershaft seal according to claim 4, wherein said elastomer seal material includes a sealing edge extending outwardly from said outer and said inner edge of said first and said second seal member.

6. A dynamic seal system for a planetary rotary internal combustion engine having a plurality of rotors each rotor having an elliptical cross section and central shaft extensions on each end with the shaft extension journalled to rotate about parallel axes in two end plates of an outer stator casing enclosing the group of rotors, said dynamic seal system comprising:

a first rotor support plate and an opposite second rotor support plate, with each said plate being statically disposed within the engine and with the rotors disposed between said first and said second plate;

rotor attachment means for securing each of the rotors rotationally thereto, each such rotor attachment means having a centerline;

means for adjustably positioning each centerline of said rotor attachment means radially from another such that adjacent rotor faces are in sliding contact with one another at all times during operation of the engine and precluding any leakage from the combustion chamber of the machine;

wherein said means for adjustably positioning each centerline includes rotor attachment means including a radially elongate housing formed within each said plate and a bearing radially adjustably disposed within said housing, each said bearing extending sealingly across a corresponding said housing; a plurality of fluid passages defined by said plate, with each of said passages communicating with a corresponding said housing; and a pressurized fluid passed through said fluid passages and into said corresponding said housing in response to thermodynamic and structural changes of said rotor and for adjustably positioning each said bearing radially within said corresponding said housing;

means for sealing the rotor shaft including a plurality of annular fulcrum elements, a plurality of pivoting arms annularly disposed about each said annular fulcrum elements, and means for flexibly encasing said annular fulcrum elements and said respective pivoting arms, wherein said means for sealing the rotor shaft respectively surrounds each rotor shaft, disposed between the casing and each rotor face; and at least one annular surface depression disposed in at least one of the casing surface end wall and each rotor end, each said annular surface depression changing the velocity of a fluid passing through a gap between the casing surface and the rotor end, whereby pressure and vacuum pulses passing between each rotor end and the end wall of the casing are attenuated.

7. The rotor face sealing means according to claim 6, wherein said fluid is hydraulic fluid.

8. The rotor face sealing means according to claim 6, wherein said fluid is a pressurized gas.

9. A dynamic seal system for a planetary rotor engine having a casing, at least two end walls each having an inner surface and a plurality of internal rotors, each rotor having a rotor end and a rotor face, each said rotor mounted on a rotor shaft having a centerline and positioned to cause contact of adjoining rotor faces and thereby define a combustion chamber, further defining a gap between said rotor end and said casing, said dynamic seal system comprising:

a first rotor support plate and an opposite second rotor support plate, with each said plate being statically disposed within the engine and with the rotors disposed between said first and said second plate;

rotor attachment means for securing each of the rotors rotationally thereto, each such rotor attachment means having a centerline; and means for adjustably positioning each centerline of said rotor attachment means radially from another such that adjacent rotor faces are in sliding contact with one another at all times during operation of the engine and precluding any leakage from the combustion chamber of the machine;

wherein said means for adjustably positioning each centerline includes rotor attachment means including a radially elongate housing formed within each said plate and a bearing radially adjustably disposed within said housing, each said bearing extending sealingly across a corresponding said housing; and means for radially and adjustably shifting said bearing within said corresponding said housing responsive to one of thermodynamic and structural changes of said rotor, said means for shifting being disposed within each said housing and sandwiching a corresponding said bearing adjustably therebetween, to radially move each respective said centerline of each said shaft;

means for sealing the rotor shaft including a plurality of annular fulcrum elements, a plurality of pivoting arms annularly disposed about each said annular fulcrum elements, and means for flexibly encasing said annular fulcrum elements and said respective pivoting arms, wherein said means for sealing the rotor shaft respectively surrounds each rotor shaft, disposed between the casing and each rotor face; and at least one annular surface depression disposed in at least one of the casing surface end wall and each rotor end, each said annular surface depression changing the velocity of a fluid passing through a gap between the casing surface and the rotor end, whereby pressure and vacuum pulses passing between each rotor end and the end wall of the casing are attenuated.

10. The dynamic seal system according to claim 9, wherein said means for shifting includes an inner and an outer cam disposed within each said housing and sandwiching a corresponding said bearing adjustably therebetween, said inner and said outer cam are eccentrically and cooperatingly rotated to radially move said centerline of said shaft.

11. The dynamic seal system according to claim 9, wherein said means for shifting includes an inner and an outer adjustment screw disposed within each said housing and sandwiching a corresponding said bearing adjustably therebetween, whereby said bearing is shifted by rotating said inner and said outer adjustment screw to radially move said centerline of said shaft.

12. The dynamic seal system according to claim 9, wherein said means for shifting includes an inner and an outer adjustment solenoid disposed within each said housing and sandwiching a corresponding said bearing adjustably therebetween, whereby said bearing is shifted by extending and retracting said inner and said outer adjustment solenoid.

13. A dynamic rotor face seal for a planetary rotor engine having a plurality of internal rotors, each rotor mounted on a rotor shaft having a centerline and positioned to cause contact of adjoining rotor faces and thereby define a combustion chamber, said dynamic rotor face seal comprising:

a first rotor support plate and an opposite second rotor support plate, with each said plate being statically disposed within the engine and with the rotors disposed between said first and said second plate;

rotor attachment means for securing each of the rotors rotationally thereto, each such rotor attachment means having a centerline; and means for adjustably positioning each centerline of said rotor attachment means radially from another such that adjacent rotor faces are in sliding contact with one another at all times during operation of the engine and precluding any leakage from the combustion chamber of the machine;

wherein said means for adjustably positioning each centerline includes:

said support plate having an inner portion and an outer portion, said inner portion including at least one heating passage and at least one cooling passage disposed inwardly of each said rotor attachment means of each said plate, said outer portion including at least one heating passage and at least one cooling passage disposed outwardly of each said rotor attachment means of each said plate;

means for sensing plate temperatures; and means for heat exchange for heating and cooling each said plate, said means passing through said heating and cooling passages for controlling thermal expansion and contraction of each said plate, for adjustably positioning each said rotor attachment means radially from one another as required for sealingly positioning each said adjacent ones of said rotors to one another.

14. A method for sealing a planetary rotary internal combustion engine having a plurality of rotors each rotor having an elliptical cross section and central shaft extensions on each end with the shaft extension journalled to rotate about parallel axes in two end plates of an outer stator casing enclosing the group of rotors, said method for sealing comprising the steps of:

defining at least one radial channel in the casing for radial movement of the centerline of each rotor shaft; and moving the centerline of the rotor shaft along the radial channel in response to at least one of thermodynamic and mechanical structural variations of the rotors during engine operation;

defining a at least one surface depression in at least one of the group consisting of the casing surface and the rotor end, the depression substantially changing the velocity of a fluid passing through the gap; and positioning a pair of opposing pivot arms depending from an annular fulcrum between the casing and the rotor shaft, wherein the fulcrum surrounds the circumference of the rotor shaft.

* * * * *